United States Patent [19]

Masuda

[11] Patent Number: 4,804,152

[45] Date of Patent: Feb. 14, 1989

[54] WEB WINDING APPARATUS

[75] Inventor: Yoshihiro Masuda, Otsu, Japan

[73] Assignee: Dainippon Screen Mfg. Co., Ltd., Kyoto, Japan

[21] Appl. No.: 53,340

[22] Filed: May 21, 1987

[30] Foreign Application Priority Data

May 26, 1986 [JP] Japan ..... 61-79248[U]

[51] Int. Cl.[4] ..... B65H 18/08

[52] U.S. Cl. ..... 242/67.1 R; 242/68.7

[58] Field of Search ..... 242/67.1 R, 68.7, 78.7, 242/76, 54 R, 68, 129.5, 66, 57.1

[56] References Cited

U.S. PATENT DOCUMENTS

| | | | |
|---|---|---|---|
| 2,679,987 | 6/1954 | Saliba | 242/66 |
| 2,687,854 | 8/1954 | Lorig | 242/76 |
| 2,760,544 | 8/1956 | Lorig | 242/78.7 |
| 2,904,273 | 9/1959 | Turner, Jr. et al. | 242/68.7 X |
| 3,198,449 | 8/1965 | Scher | 242/68.7 X |
| 3,743,205 | 7/1973 | Misrach | 242/68.7 |
| 3,973,446 | 8/1976 | Vasilantone | 242/57.1 |

FOREIGN PATENT DOCUMENTS

| | | | |
|---|---|---|---|
| 1081095 | 5/1960 | Fed. Rep. of Germany | 242/129.5 |
| 591381 | 9/1977 | Switzerland | 242/68.7 |

*Primary Examiner*—John M Jillions

*Attorney, Agent, or Firm*—Lowe, Price, Leblanc, Becker & Shur

[57] ABSTRACT

A web winding apparatus, which comprises a reel including a winding shaft and flanges fixed to the winding shaft; a pair of rollers for driving the reel under frictional drive imparted thereto through the flanges; at least one of the driving rollers having collars at opposite ends through which the driving roller imparts the frictional drive to the reel; and wherein each collar is provided with a tapered portion whereby the displacement of the reel is constantly remedied to its normal state.

7 Claims, 7 Drawing Sheets

WEB WINDING APPARATUS

BACKGROUND OF THE INVENTION

1. Field of the Invention

The present invention relates to a web winding apparatus, and more particularly to a web winding apparatus adapted for use in association with an automatic developing unit so as to wind a developed photosensitive sheet automatically.

2. Description of the Prior Art

To explain the background of the present invention reference will be made to FIG. 10:

An exposed photosensitive sheet 4 is subjected to a series of developing treatments while passing through a developer tank 6, a fixing tank 8, a cleansing tank 10 and a drying section 12, and is then finally wound around a winder 14. Hereinafter, the photosensitive sheet to be wound will be referred to merely as a "sheet".

As depicted in FIGS. 11 and 12, winder 14 includes a pair of side plates 16, two driving rollers 18, 20 carried between the side plates 16, and a reel 24 which is made up of a shaft 21 and flanges 22 provided at opposite ends of the shaft 21. A stop 25 limits movement of the flanges 22 along the driving rollers 18 and 20. The rollers 18 and 20 contact the peripheries of the flanges 22 to impart frictional drive thereto.

The reel 24 rotates in accordance with the rotation of either of the rollers 18, 20 or both by a motor 26. The rotating speed of the reel 24 depends upon the feeding speed of the sheet 4 in the developing unit. Consequently there is unavoidably some degree of slip occurring between the flanges 22 and the rollers 18, 20.

In the developing units it often happens that the feeding sheet tends to fluctuate in a zigzag manner. When the sheet is fed in this manner and placed on the reel, the roll of the sheet has different thicknesses at opposite ends of the winding shaft. In general, when a sheet is wound around the shaft it is essential that the advancing direction of the sheet should be perpendicular to the axis of the winding shaft. The fluctuation of the feeding sheet leads to detrimental creases and/or folds when it is wound on the shaft.

OBJECTS AND SUMMARY OF THE INVENTION

The present invention aims at solving the problems pointed out above, and has for its object to provide a web winding apparatus which ensures that a web is wound on a reel in a neat and orderly manner irrespective of the fact that the web tends to fluctuate in a zigzag manner during feeding from the developing unit.

Other objects and advantages of the present invention will become more apparent from the following detailed description, when taken in conjunction with the accompanying drawings which show, for the purpose of illustration only, one embodiment in accordance with the present invention.

According to the present invention there is provided a web winding apparatus, which comprises:

a reel including a winding shaft and flanges fixed to the winding shaft;

a pair of rollers for driving the reel under frictional drive imparted thereto through the flanges;

at least one of the driving rollers having collars at opposite ends through which the driving roller imparts the frictional drive to the reel; and wherein each collar is provided with a tapered portion whereby the displacement of the reel is constantly remedied to its normal state.

DETAILED DESCRIPTION OF THE INVENTION

Figure 8:
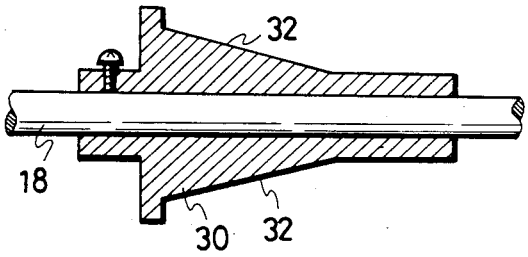
Figure 9:
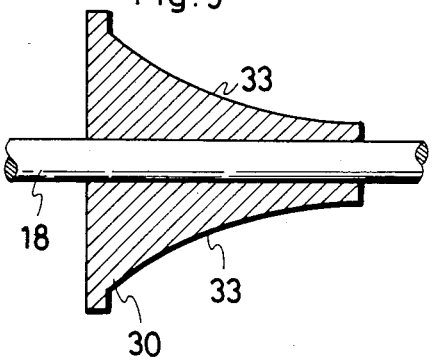
Figure 10:
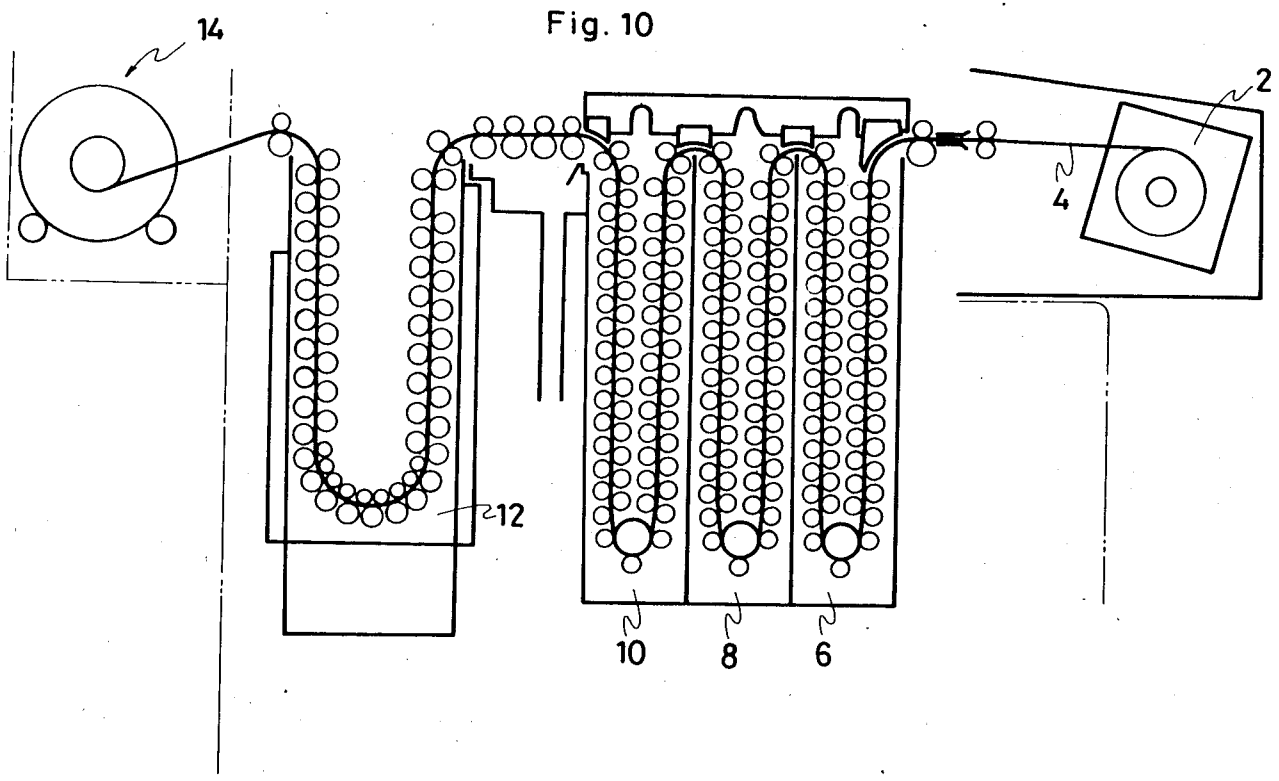
FIG. 10 is a diagrammatic view of a typical example of the known developing unit.
Figure 11:
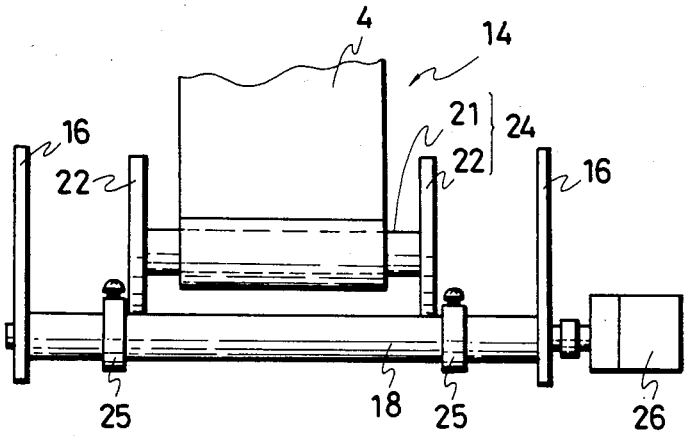
Fig. 11 PRIOR ART
FIGS. 11 and 12 are a front view of a known web winding apparatus and a side view of the reel section thereof, respectively.
Figure 12:
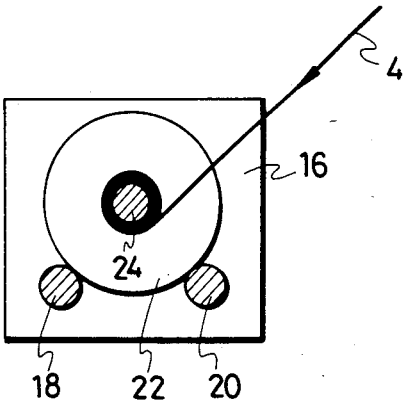
Fig. 12 PRIOR ART

In FIGS. 1 to 9 like parts and components to those in FIGS. 10 and 11 are indicated by like reference numerals.

The driving roller 18 has a pair of collars 30 freely fitted thereon, each of which has a tapered portion 32. The collars 30 are fitted on the roller 18 with their tapered portions 32 becoming smaller inwards. The reference numeral 34 denotes a stop having a screw 36 whereby the stop is fixed to the roller 18. The collars 32 are movable along the roller 18 between the opposite stops 34.

When the motor 26 is driven the roller 20 is rotated, and the roller 18 linked thereto by a belt 28 is rotated, thereby enabling the reel 24 to rotate under the frictional drive transmitted thereto through the flanges 22. The rotating speed of the reel 24 depends upon the feeding speed of the sheet 4, thereby allowing some degree of slip to occur between the flanges 22 and the rollers 18, 20.

Figure 3:
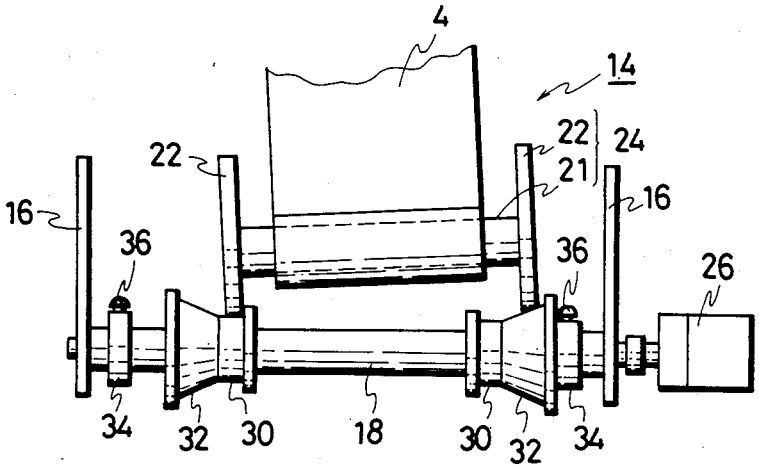
FIG. 3 is a front view of the apparatus in which the reel declines with respect to the axis of the winding shaft.
Figure 4:
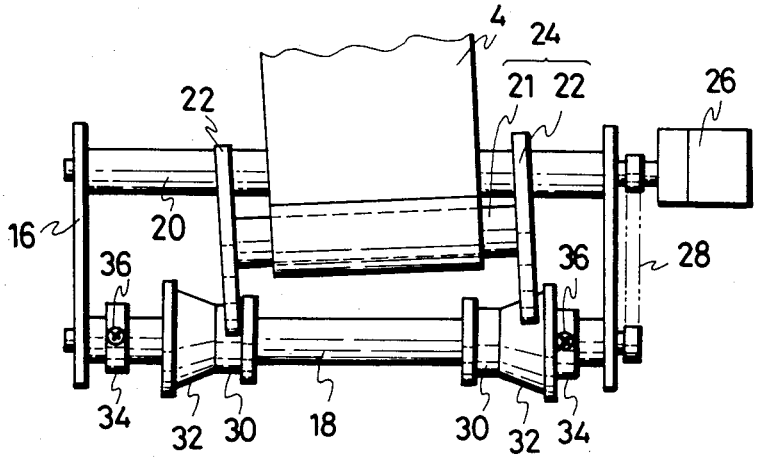
FIG. 4 is a plan view of the apparatus of FIG. 3.

In the example illustrated in FIGS. 3 and 4, the sheet 4 fluctuates in a zigzag manner while it is being fed, and the reel 24 undergoes a larger tension at its right side than at its left side. As a result, the reel 24 displaces toward the right side as shown in FIG. 4. It will be noted that the right-hand flange 22 rides on the tapered portion 32 of the right-hand collar 30. The reel 24 as a whole shifts to the right in the drawing.

Figure 1:
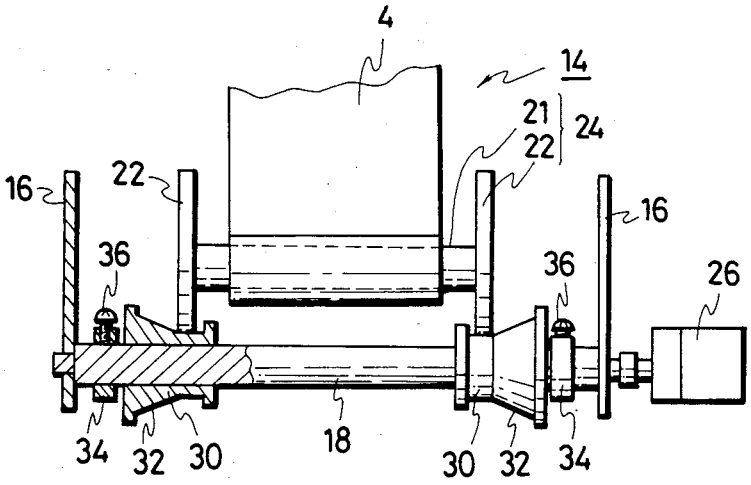
FIG. 1 is a front view of a web winding apparatus embodying the present invention.
Figure 2:
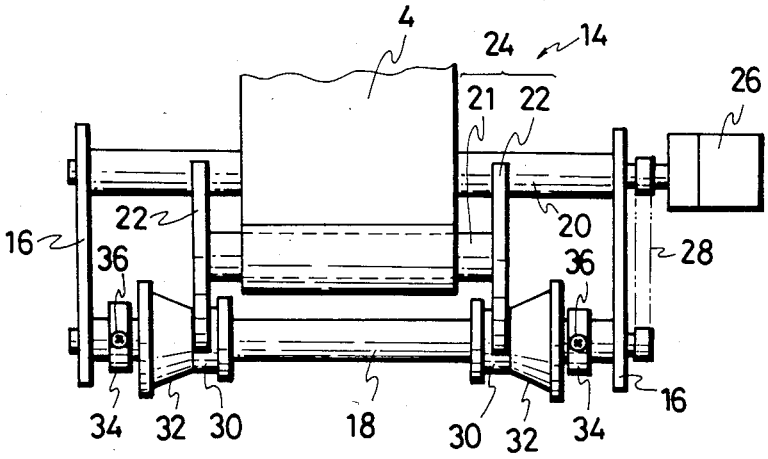
FIG. 2 is a plan view of the apparatus of FIG. 1.
Figure 5:
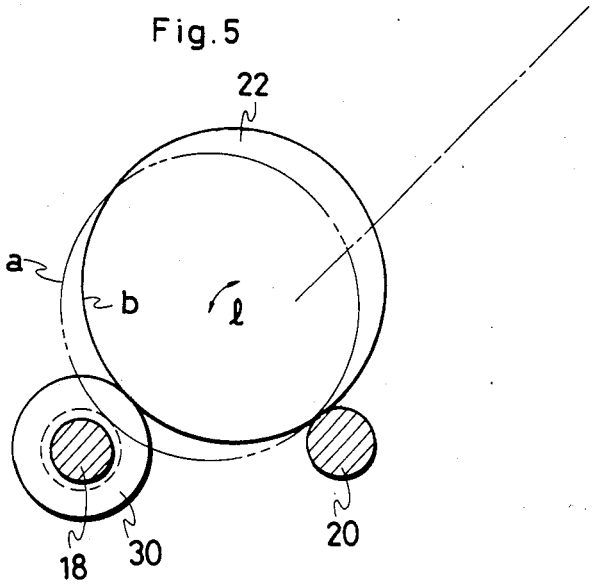
FIG. 5 is a diagrammatic view of the displacement of the reel.

Referring to FIG. 5 the line (a) indicates a state at which the flanges 22 are free from the tapered portions 32 of the respective collars 30 as shown in FIGS. 1 and 2, and the line (b) indicates a state at which the flanges 22 ride on the tapered portions 32 as shown in FIGS. 3 and 4. The displacement of the flanges 22 is expressed in terms of a distance (i) over which the axis of the roller 20 has moved along the circumference of an imaginary circle having a radius obtained by adding the radii of the roller 20 and the flange 22.

As the reel 24 becomes displaced to the right as shown in FIG. 3, the right-hand flange 22 is urged to return to the left owing to the right-hand tapered portion 32. If this happens at the left-hand side the left-hand flange is caused to returned to the right. In this way the posture of the reel 24 is constantly remedied to the normal state, thereby equalizing the tension exerting on the end portions of the sheet 4 throughout the feed thereof.

Figure 6:
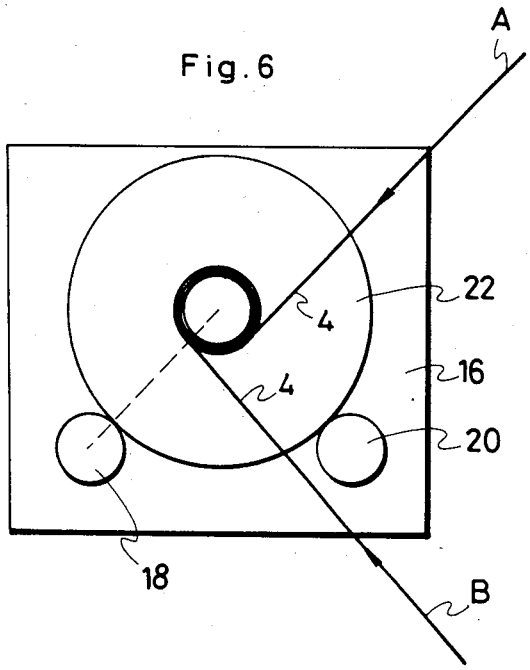
FIG. 6 is a diagrammatic side view of the structure of the reel.

FIG. 6 shows the relationships among the rollers 18, 20, the flange 22 and the sheet 4. When the sheet 4 is wound on the reel in the direction (A) the collars 30 are fixed to the roller 18 as mentioned above. However when the sheet 4 is wound on the reel in the direction (B) it is necessary to fix the collars to another roller 20, wherein the tapered portions are arranged with their diameters becoming smaller (FIG. 9*a*) outwards unlike the arrangement mentioned above, because the roller 20 is located ahead of the reel 24 in the advancing direction of the sheet. In this way it is ensured that the displacing direction of the flanges 22 is perpendicular to the direction in which the sheet 4 advances.

Figure 7:
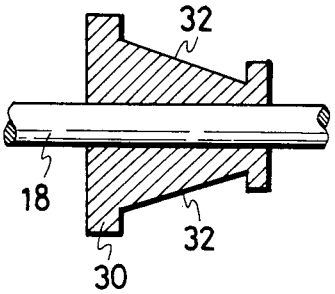
FIGS. 7 to 9 are diagrammatic views of various shapes of the collar fitted on the supporting rollers.
Figure 9A:
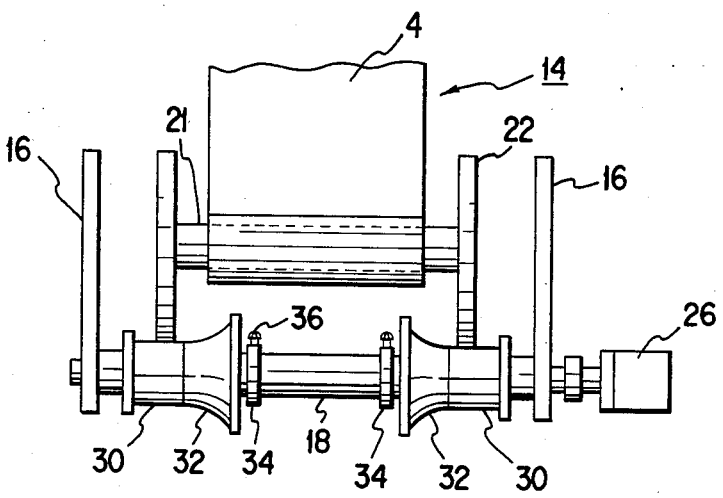
FIG. 9*a* is a diagrammatic partial schematic view of an alternate embodiment according to the present invention.

The shape of the collar 30 is not limited to the illustrated one but can be various; examples are shown in FIGS. 7 to 9. The collar shown in FIG. 7 consists mostly of the tapered portion 32, and the one shown in FIG. 8 is jointed to the roller 18 directly without the use of the stop 34 and screw 34. In this case it is necessary to provide a prolonged collar so as to avoid the flanges 22 dismounting off the collar. The collar shown in FIG. 9 has a continuously curved surface 33.

As is evident from the foregoing description the sheet can be wound on the reel in an orderly manner under the balanced tension between its opposite ends irrespective of the fact that it fluctuates in a zigzag manner during passage from the developing unit to the reel. This obviates the possibility of detrimental creases and/or folds.

What is claimed is:

1. A web winding apparatus, which comprises:

a reel including a winding shaft and flanges fixed to the winding shaft;

a pair of rollers for driving the reel under frictional drive imparted thereto through the flanges;

at least one of the driving rollers having collars at opposite ends through which the driving roller imparts frictional drive to the reel;

wherein each collar is provided with a tapered portion whose diameter becomes smaller in the direction of the reel and wherein the maximum diameter portion of each collar is spaced apart from the associated flange when said reel is substantially centered on the collars; and wherein each collar includes a generally constant diameter portion disposed adjacent each tapered portion such that the generally constant diameter portions are located between the tapered portions.

2. The web winding apparatus of claim 1, wherein said web winding apparatus winds a sheet of material onto the winding shaft.

3. The web winding apparatus of claim 1, wherein said tapered portion is a substantially continuously curved surface extending between opposite ends of the collar.

4. A web winding apparatus, which comprises:

a reel including a winding shaft and flanges fixed to the winding shaft;

a pair of rollers for driving the reel under frictional drive imparted thereto through the flanges;

at least one of the driving rollers having collars

5. The web winding apparatus of claim 4, wherein said web winding apparatus winds a sheet of material onto the winding shaft.

6. The web winding apparatus of claim 4, wherein said tapered portion is a substantially continuously curved surface extending between opposite ends of the collar.

7. A web winding apparatus, which comprises:

a reel including a winding shaft and flanges fixed to the winding shaft;

a pair of rollers for driving the reel under frictional drive imparted thereto through the flanges;

at least one of the driving rollers having collars at opposite ends through which the driving roller imparts frictional drive to the reel;

wherein each collar is provided with a tapered portion whose diameter becomes smaller in the direction of the reel and wherein the maximum diameter portion of each collar is spaced apart from the associated flange when said reel is substantially centered on the collars; and wherein each collar is provided with a flange at both ends thereof and is slidably mounted on the driving roller, the movement of the collar in an outward direction being restricted by a stopper.

* * * * *